US008166900B2

(12) United States Patent
Kamio

(10) Patent No.: US 8,166,900 B2
(45) Date of Patent: May 1, 2012

(54) DECELERATION DEVICE OF A PERSONAL WATERCRAFT

(75) Inventor: Kunihiko Kamio, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 110 days.

(21) Appl. No.: 12/756,854

(22) Filed: Apr. 8, 2010

(65) Prior Publication Data

US 2011/0247539 A1 Oct. 13, 2011

(51) Int. Cl.
*B63H 25/44* (2006.01)

(52) U.S. Cl. ..... 114/145 R

(58) Field of Classification Search ..... 114/145 R, 114/146

See application file for complete search history.

(56) References Cited

U.S. PATENT DOCUMENTS 2,691,497 A * 10/1954 Kass et al. ..... 244/112
3,159,134 A * 12/1964 Winnen ..... 440/43
6,520,104 B1 * 2/2003 Svensson ..... 114/144 R
6,691,634 B2 2/2004 Fritchle
7,007,621 B1 3/2006 Bootes

FOREIGN PATENT DOCUMENTS

JP 2001191992 7/2001

* cited by examiner

*Primary Examiner* — Edwin Swinehart
(74) *Attorney, Agent, or Firm* — Alleman Hall McCoy Russell & Tuttle LLP

(57) ABSTRACT

A personal watercraft configured to eject water rearward from a body thereof to generate a propulsive force, includes a pair of right and left resistive elements which are attached to the body and configured to be able to receive water resistance during travel of the watercraft. The resistive elements are configured to move between an operating position and a non-operating position, the water resistance being larger in the operating position than in the non-operating position. Each of the resistive elements includes a pressure receiving section configured to receive the water resistance in the operating position, and wherein in the operating position, at least a portion of the pressure receiving section is located outward relative to a coupling portion where the resistive element is coupled to the body, in a width direction of the body.

10 Claims, 8 Drawing Sheets

DECELERATION DEVICE OF A PERSONAL WATERCRAFT

BACKGROUND OF THE INVENTION

1. Field of the Invention

The present invention relates to a personal watercraft (PWC) which is configured to eject water rearward from a body thereof to generate a propulsive force.

2. Description of the Related Art

A personal watercraft is configured to be decelerated by water resistance applied to a body thereof. It is desired that the personal watercraft be decelerated with a high responsiveness to a rider's operation of moving a throttle lever to a closed position. If the body of the watercraft is designed to increase the water resistance applied to the body, its acceleration capability and fuel efficiency decrease.

U.S. Pat. No. 6,691,634 and U.S. Pat. No. 7,007,621 disclose a technique in which a resistive element protrudes downward from a hull bottom as desired at the rear portion of a body to allow the body to be decelerated by the water resistance. If the water resistance applied to the resistive element protruding downward from the rear portion of the body increases, a stern portion moves up and a fore portion moves down in a principle of leverage, so that the body tilts forward to a great extent. Therefore, there is a need for a body structure which enables sufficient deceleration while suppressing a change of body attitude.

SUMMARY OF THE INVENTION

According to the present invention, a personal watercraft configured to eject water rearward from a body thereof to generate a propulsive force, comprises a pair of right and left resistive elements which are attached to the body and configured to be able to receive water resistance during travel of the watercraft. The resistive elements are configured to move between an operating position and a non-operating position, the water resistance being larger in the operating position than in the non-operating position; wherein each of the resistive elements includes a pressure receiving section configured to receive the water resistance in the operating position; and wherein in the operating position, at least a portion of the pressure receiving section is located outward relative to a coupling portion where the resistive element is coupled to the body, in a width direction of the body.

In accordance with such a configuration, since at least a portion of the pressure receiving section of the resistive element in the operating position is located outward relative to the coupling portion where the resistive element is coupled to the body, in the width direction of the body, the force applied to the body has a substantially horizontal major component in a principle of leverage in which the pressure receiving section is a force application point and the coupling portion is a pivot point. This makes it possible to suppress the fore portion of the body from moving downward by the water force applied to the resistive element. As a result, a sufficient deceleration capability is attainable while suppressing a change in an attitude of the body.

The above and further objects and features of the invention will more fully be apparent from the following detailed description with reference to the accompanying drawings.

DETAILED DESCRIPTION OF THE PREFERRED EMBODIMENTS

Hereinafter, an embodiment of the present invention will be described with reference to the drawings. As used herein, the stated directions refer to directions from the perspective of a rider straddling a watercraft, unless otherwise explicitly noted.

Figure 1:
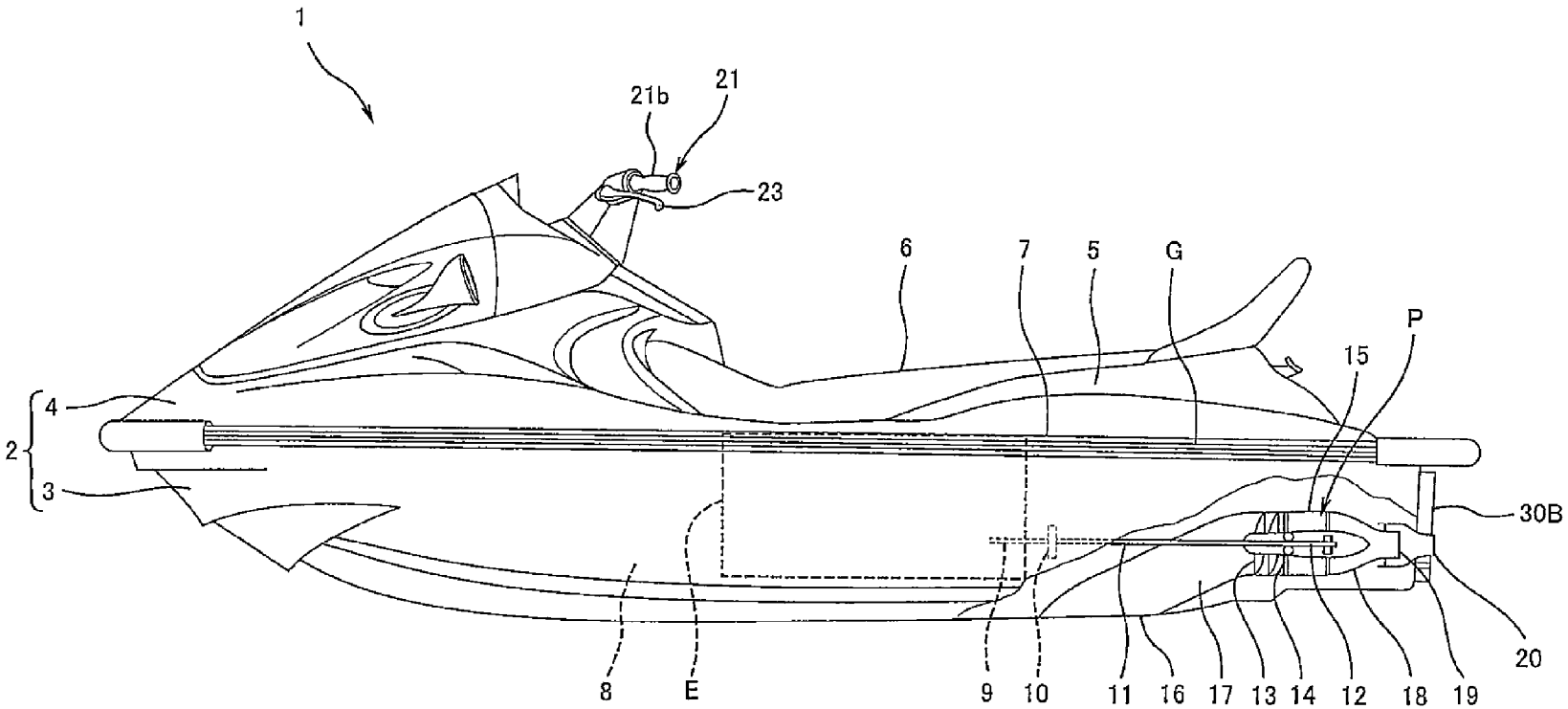
FIG. 1 is a left side view of personal watercraft according to an embodiment of the present invention, a part of which is cut away.

FIG. 1 is a left side view of personal watercraft 1 according to an embodiment of the present invention. As shown in FIG. 1, the watercraft 1 includes a body 2 including a hull 3 and a deck 4 covering the hull 3 from above. The hull 3 and the deck 4 are connected to each other by a gunnel line section G which protrudes horizontally outward from the body 2. A center region in a width direction of the rear portion of the deck 4 protrudes upward to form a protruding portion 5. A seat 6 is mounted over the upper surface of the protruding portion 5. A deck floor 7 is provided on opposite (right and left) sides in the width direction of the protruding portion 5. The deck floor 7 is lower than the protruding portion 5 and is substantially flat to allow the rider to put the rider's feet thereon.

An engine E is mounted in an inner space 8 defined by the hull 3 and the deck 4 below the seat 6. A crankshaft 9 of the engine E extends in a longitudinal direction of the body 2. The output end portion of the crankshaft 9 is coupled to a propeller shaft 11 by a coupling device 10. The propeller shaft 11 is coupled to a pump shaft 12 of a water jet pump P disposed at the rear portion of the body 2. The propeller shaft 11 and the pump shaft 12 rotate in association with rotation of the crankshaft 9. An impeller 13 is attached on the pump shaft 12. Fairing vanes 14 are provided behind the impeller 13. The impeller 13 is covered with a tubular pump casing 15 at an outer periphery thereof.

A water intake 16 opens in a bottom surface of the hull 3 of the body 2. The water intake 16 is connected to the pump casing 15 through a water passage 17. A pump nozzle 18 is provided on the rear side of the body 2 and is coupled to the pump casing 15. The pump nozzle 18 has a cross-sectional area that is gradually reduced rearward, and an outlet port 19 is open at the rear end of the pump nozzle 18. A steering nozzle 20 is coupled to the pump nozzle 18 near the outlet port 19 such that it extends rearward and is pivotable to the right or to the left.

In the above constructed personal watercraft 1, water outside the watercraft 1 is sucked from the water intake 16 provided on the bottom surface of the hull 3 and is fed to the water jet pump P. Driven by the engine E, the impeller 13 of the water jet pump P pressurizes and accelerates the water. The fairing vanes 14 guide water flow behind the impeller 13.

The water is ejected fast rearward from the outlet port 19 of the pump nozzle 18 and through the steering nozzle 20. As the resulting reaction, the watercraft 1 obtains a propulsive force.

A bar-type steering handle 21 is provided in front of the seat 6. The handle 21 is coupled to the steering nozzle 20 via a steering cable (not shown). When the rider rotates the handle 21 clockwise or counterclockwise, the steering nozzle 20 rotates clockwise or counterclockwise in association with the rotation of the handle 21. By operating the handle 21 while the water jet pump P is generating the propulsive force by ejecting water rearward, the direction of the water being ejected outside through the steering nozzle 20 is tilted to the left or to the right. As a result, the watercraft 1 turns. A throttle lever 22 (see FIG. 2) is attached to a right grip 21*a* of the handle 21 and gripped by the rider's right hand. A deceleration lever 23 (deceleration operation unit) is attached to a left grip 21*b* of the handle 21, and is gripped by the rider's left hand.

Figure 2:
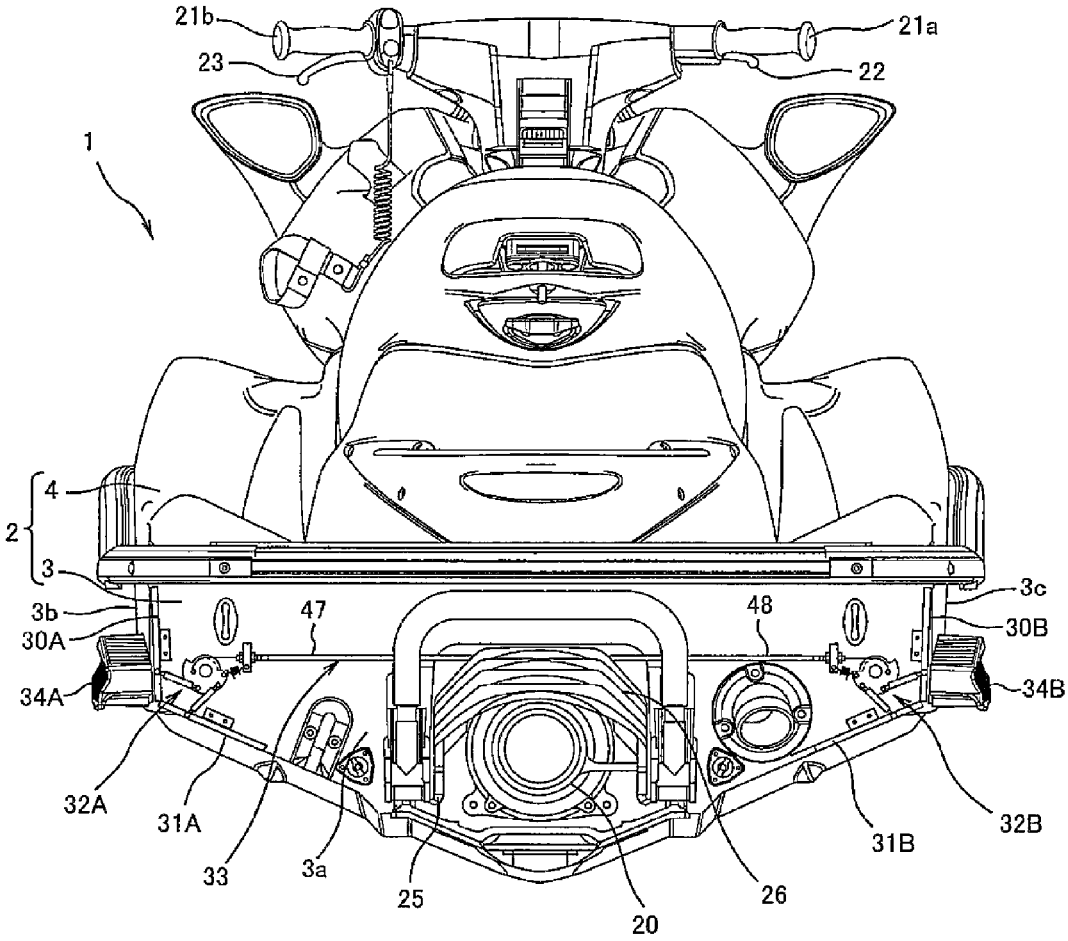
FIG. 2 is a rear view of personal watercraft in a state where resistive elements are in a non-operating position.

FIG. 2 is a rear view of the watercraft 1 in a state where resistive elements 30A, 30B, 31A and 31B are in a non-operating position. As shown in FIG. 2, an opening 25 is formed at a center region of a transom board 3*a* (stern board) forming the back surface of the hull 3. The steering nozzle 20 is accommodated into the opening 25. A reverse bucket 26 is positioned above the steering nozzle 20 such that the reverse bucket 26 is vertically pivotable. The vertical resistive elements 30A and 30B and the horizontal resistive elements (auxiliary resistive elements) 31A and 31B are movably provided at right and left end portions of the transom board 3*a*. The vertical resistive elements 30A and 30B and the horizontal resistive elements 31A and 31B are mechanically coupled to the deceleration lever 23 via a cable mechanism 33 and link mechanisms 32A and 32B constituting a driving power transmission mechanism. Stabilizers 34A and 34B protrude forward from the rear end portions of the both side surfaces of the hull 3.

The resistive elements 30A and 31A and the link mechanism 32A at the left side are laterally symmetric with respect to the right resistive elements 30B and 31B and the link mechanism 32B at the right side. Therefore, the resistive elements 30A and 31A and the link mechanism 32A at the left side will be described hereinafter.

Figure 3:
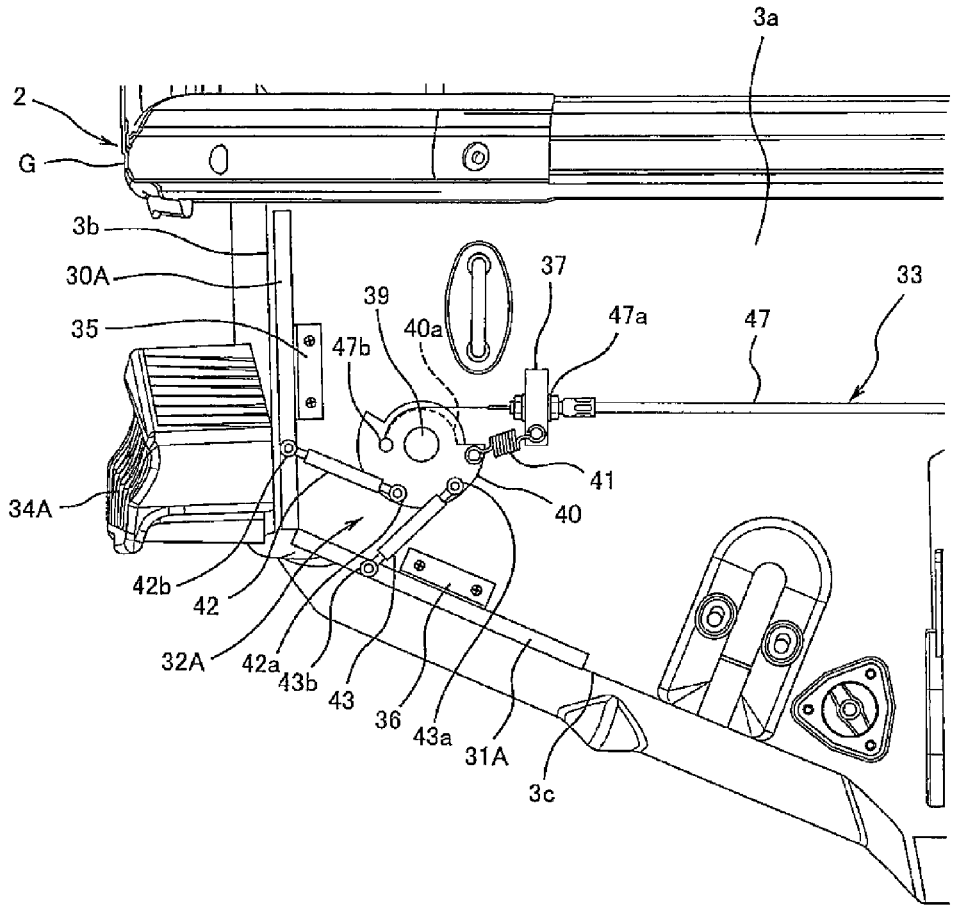
FIG. 3 is an enlarged view of the main constituents of the personal watercraft of FIG. 2.
Figure 4:
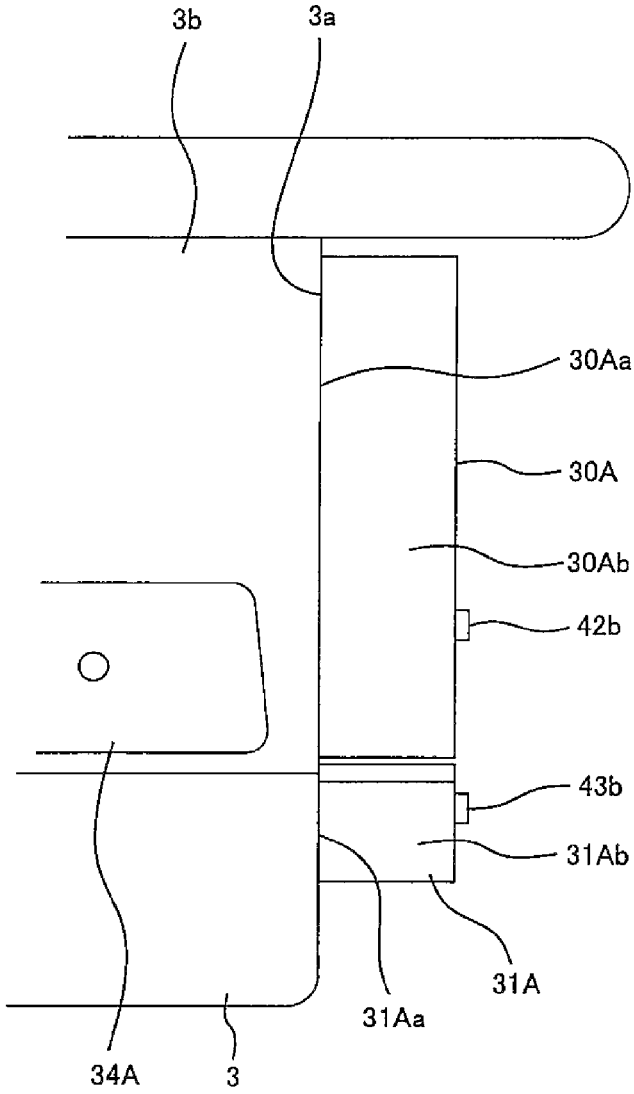
FIG. 4 is a left side view of the rear portion of the personal watercraft of FIG. 2.

FIG. 3 is an enlarged view of main constituents of the watercraft 1 of FIG. 2. FIG. 4 is a left side view of the rear portion of the watercraft 1. Referring to FIGS. 3 and 4, the vertical resistive element 30A is formed by a rectangular plate oriented substantially vertically. The vertical resistive element 30A protrudes rearward along a side edge 3*b* of the left end portion of the transom board 3*a*. The vertical resistive element 30A is connected to the body 2 via a hinge 35 which serves as a rotation mechanism for allowing the vertical resistive element 30A to rotate. In this structure, the front end portion of the vertical resistive element 30A serves as a pivot point portion 30Aa having a rotational axis extending substantially vertically. The vertical resistive element 30A is rotatable around the pivot point portion 30Aa, outward in a width direction of the body 2, to be precise, to the left. In the state where the rear end portion of the vertical resistive element 30A is at the left position, the left outer surface (main surface) of the vertical resistive element 30A is a pressure receiving section 30Ab which receives water resistance during traveling of the watercraft 1.

The horizontal resistive element 31A is a rectangular plate oriented substantially horizontally. To be more specific, the horizontal resistive element 31A is tilted slightly downward toward the center of the body 2. The horizontal resistive element 31A protrudes rearward along a bottom edge 3*c* of the left end portion of the transom board 3*a*. The horizontal resistive element 31A is coupled to the body 2 via a hinge 36 which serves as a rotation mechanism for allowing the horizontal resistive element 31A to rotate. In this structure, the front end portion of the horizontal resistive element 31A serves as a pivot point portion 31Aa having a rotational axis extending in substantially rightward and leftward directions, to be precise, slightly downward toward the center of the body 2. The horizontal resistive element 31A is rotatable downward in a vertical direction of the body 2 around the pivot point portion 31Aa. In a state where the rear end portion of the horizontal resistive element 31A is in a downward position, the lower outer surface (main surface) of the horizontal resistive element 31A serves as a pressure receiving section 31Ab which receives water resistance during the travel.

The vertical resistive element 30A and the horizontal resistive element 31A are configured to rotate by a driving power transmitted through the cable mechanism 33 and the link mechanism 32A. A second cable 47 of the cable mechanism 33 as described later has a fixing portion 47*a* at a tip end thereof and the fixing portion 47*a* is fixed to a fixed portion 37 protruding from the transom board 3*a*. A tip end portion 47*b* of the second cable 47 is coupled to the link mechanism 32A.

The link mechanism 32A includes a support shaft 39 protruding rearward from the transom board 3*a* in the vicinity of the fixed portion 37 and a rotatable board 40 which is rotatably attached to the support shaft 39. The tip end portion 47*b* of the second cable 47 is fixed to the rotatable board 40. When the tip end portion 47*b* of the second cable 47 moves to an advanced position or a retracted position, the rotatable board 40 rotates around the support shaft 39. The rotatable board 40 is provided with a guide member 40*a* of a circular-arc shape protruding forward to guide the region surrounding the tip end portion 47*b* of the second cable 47.

A first arm 42 is coupled at one end portion thereof to the outer peripheral portion of the rotatable board 40 by a rotatable joint 42*a*. The first arm 42 is coupled at an opposite end portion thereof to the rear end portion of the vertical resistive element 30A by a rotatable joint 42*b*. A second arm 43 is coupled at one end portion thereof to the outer peripheral portion of the rotatable board 40 by a rotatable joint 43*a*. The second arm 43 is coupled at an opposite end portion thereof to the rear end portion of the horizontal resistive element 31A by a rotatable joint 43*b*. When the rotatable board 40 rotates clockwise in FIG. 3, the one end portions of the first arm 42 and the second arm 43 move closer to the vertical resistive element 30A and the horizontal resistive element 31A, respectively. The opposite end portion of the first arm 42 presses the vertical resistive element 30A, causing the vertical resistive element 30A to rotate to the left, while the opposite end portion of the second arm 43 presses the horizontal resistive element 31A, causing the horizontal resistive element 31A to rotate downward. The rotatable board 40 is coupled to the fixed portion 37 by a spring 41. The spring 41 applies a force to cause the rotatable board 40 which has been rotated clockwise by the second cable 47 to return to its initial position.

In the state where the vertical resistive element 30A and the horizontal resistive element 31A are in a non-operating position (see FIG. 3), the pressure receiving sections 30Ab and 31Ab are in a first attitude in which they extend along the longitudinal direction of the body 2, and the vertical resistive element 30A and the horizontal resistive element 31A are located inward relative to the outer edges 3*b* and 3*c* of the transom board 3*a* in a rear view. It will be appreciated that each of the resistive elements is biased to the non-operating position by the associated spring.

Figure 5A:
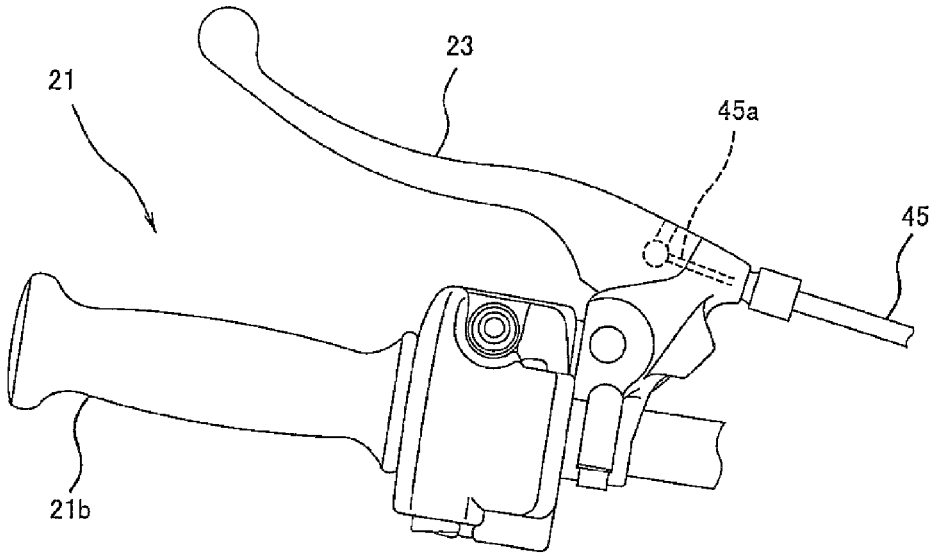
FIG. 5A is a plan view showing a region surrounding a deceleration lever of the personal watercraft.
Figure 5B:
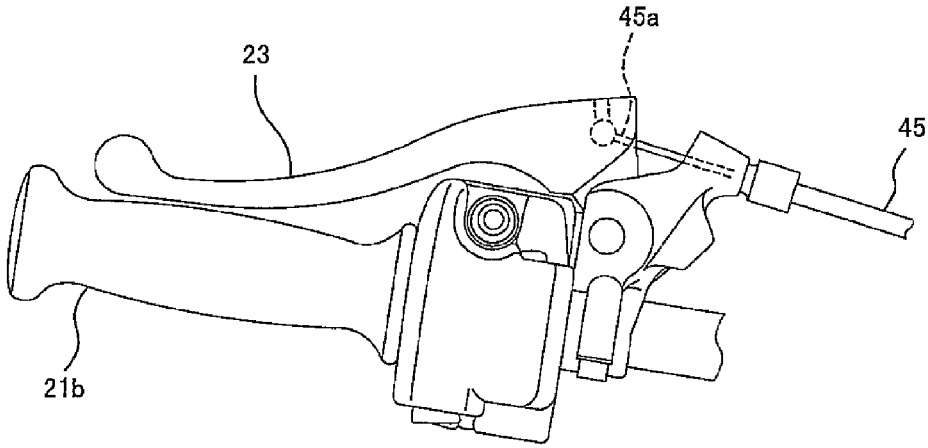
FIG. 5B is a plan view showing the region surrounding the deceleration lever, in a state where the deceleration lever of FIG. 5A is operated.

FIG. 5A is a plan view showing a region surrounding the deceleration lever 23 of the personal watercraft 1, and FIG. 5B is a plan view showing the region surrounding the deceleration lever 23, in a state where the deceleration lever 23 of FIG. 5A is operated. As shown in FIG. 5A, the deceleration lever 23 is attached on the left grip 21*b* of the steering handle 21. The deceleration lever 23 is gripped by the rider's left hand. A tip end portion 45*a* of a first cable 45 of the cable mechanism 33 as described later is coupled to the inner end portion of the deceleration lever 23. In a state where the deceleration lever 23 is not operated by the rider, the deceleration lever 23 is subjected to a force from a spring (not shown) so that the lever 23 is distant from the grip 21*b*. As shown in FIG. 5B, when the deceleration lever 23 is gripped by the rider and moves closer to the grip 21*b*, the tip end portion 45*a* of the first cable 45 is pulled. When the rider releases the deceleration lever 23, the deceleration lever 23 returns to its initial position by the force applied from the spring.

Figure 6:
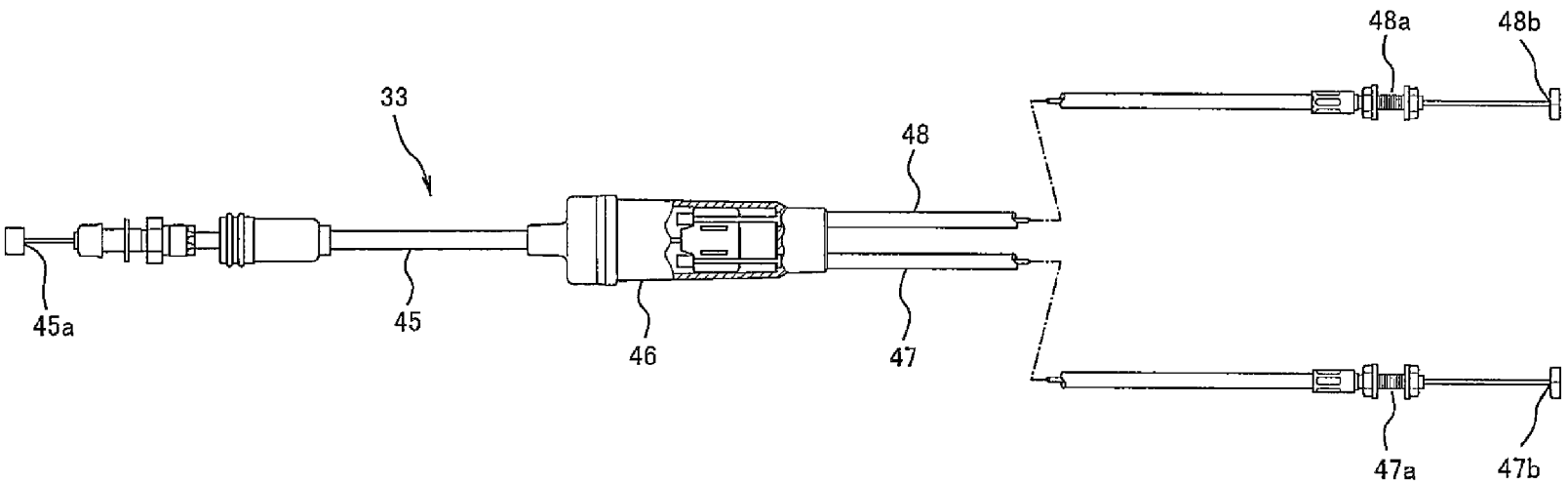
FIG. 6 is a plan view of a cable mechanism for coupling the deceleration lever to the resistive elements in the personal watercraft.

FIG. 6 is a plan view of the cable mechanism 33 for coupling the deceleration lever 23 to the resistive elements 30A, 30B, 31A and 31B. As shown in FIG. 6, the cable mechanism 33 is configured to transmit the movement of the deceleration lever 23 (see FIGS. 5A and 5B) to the link mechanisms 32A and 32B. The cable mechanism 33 includes the first cable 45, a coupling member 46 attached to the rear end portion of the first cable 45, and the second cable 47 and a third cable 48, which are a pair of right and left cables extending rearward from the coupling member 46. The first cable 45, the second cable 47 and the third cable 48 are push-pull cables. The tip end portion 45*a* of the first cable 45 is coupled to the deceleration lever 23 (FIGS. 5A and 5B), while the tip end portion 47*b* of the second cable 47 is coupled to the link mechanism 32A and the tip end portion 48*a* of the third cable 48 is coupled to the link mechanism 32B (see FIG. 2). The coupling member 46 is configured to transmit the push/pull operation of the first cable 45 as the push/pull operation of the second and the cables 47 and 48.

Figure 7:
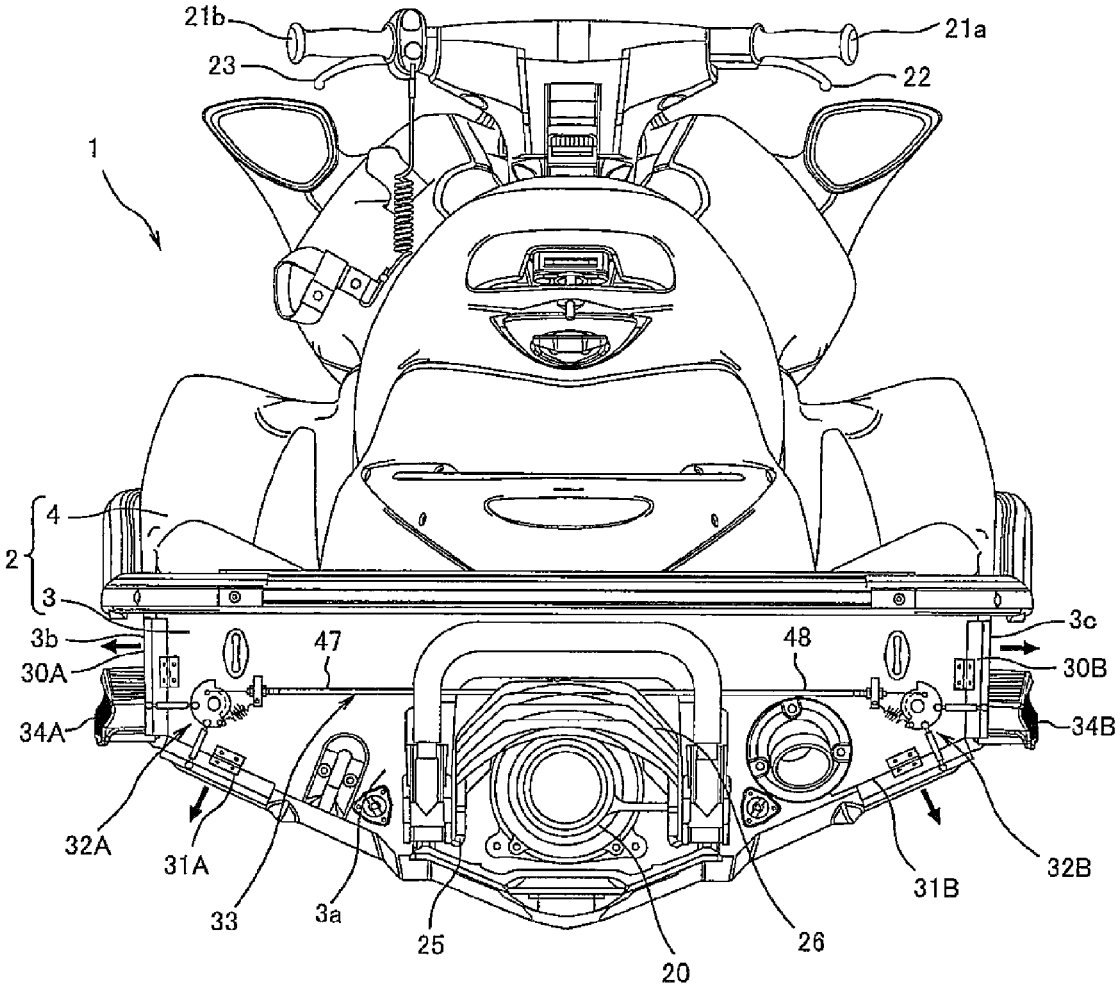
FIG. 7 is a rear view of the personal watercraft in a state where the resistive elements are in an operating position.
Figure 8:
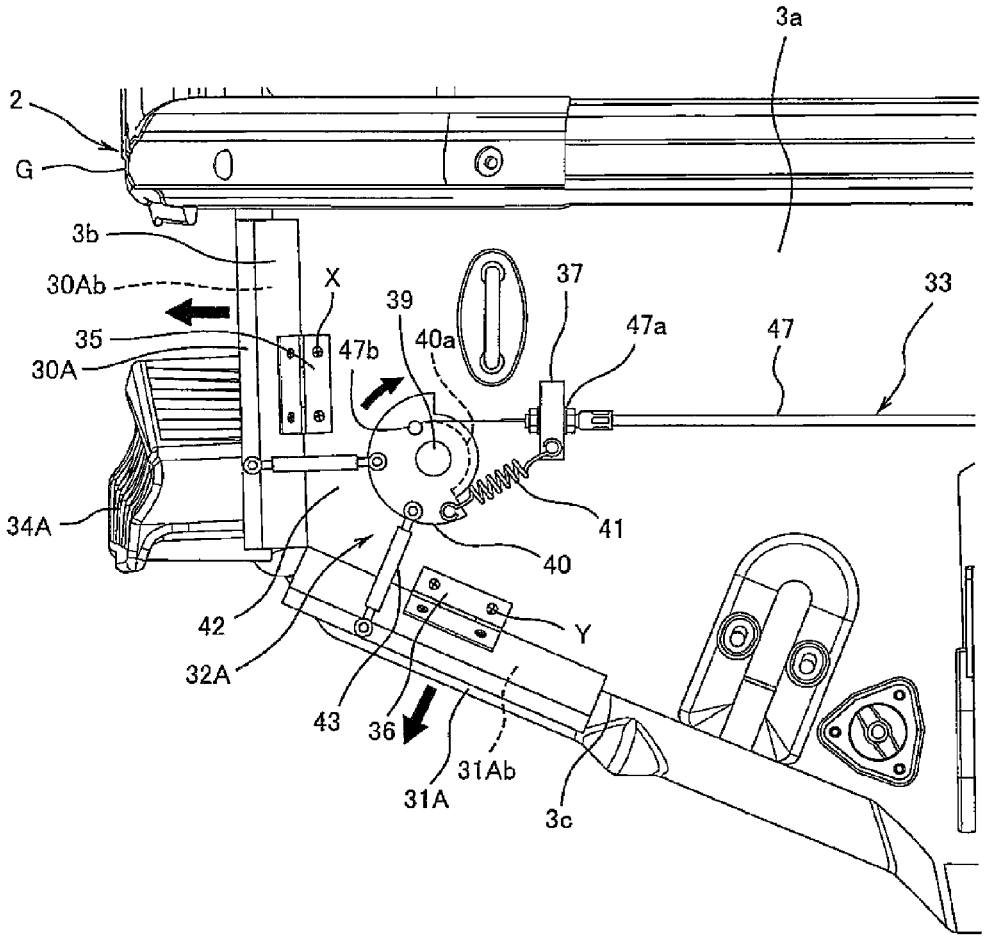
FIG. 8 is an enlarged view of the constituents of FIG. 7.

FIG. 7 is a rear view of the personal watercraft 1 in a state where the resistive elements 30A, 30B, 31A and 31B are in an operating position. FIG. 8 is an enlarged view of the constituents of FIG. 7. As shown in FIGS. 7 and 8, upon the deceleration lever 23 being operated (see FIG. 5B) by the rider, the second and third cables 47 and 48 are pulled, and a force for placing the resistive elements 30A, 30B, 31A and 31B in the operating position is transmitted to the link mechanisms 32A and 32B. Hereinafter, the resistive elements 30A and 31A and the link mechanism 32A located at the left side will be described.

As shown in FIG. 8, upon the deceleration lever 23 being operated (see FIG. 5B), the tip end portion 47*b* of the second cable 47 moves toward the center of the body 2, causing the rotatable board 40 to rotate clockwise in FIG. 8 against the spring 41. The one end portion of the first arm 42 which is coupled to the rotatable board 40 moves closer to the vertical resistive element 30A. The opposite end portion of the first arm 42 presses the vertical resistive element 30A, causing the vertical resistive element 30A to rotate to the left, while the one end portion of the second arm 43 which is coupled to the rotatable board 40 moves closer to the horizontal resistive element 31A, causing the horizontal resistive element 31A to rotate downward.

In the operating position, the vertical resistive element 30A and the horizontal resistive element 31A are in a second attitude in which the pressure receiving sections 30Ab and the 31Ab are tilted with respect to the longitudinal direction of the body 2, and the pressure receiving section 30Ab of the vertical resistive element 30A is located outward relative to the outer edge 3*b* of the transom board 3*a* and the pressure receiving section 31Ab of the horizontal resistive element 31A is located outward relative to the outer edge 3*c* of the transom board 3*a*, as viewed from the rear. In the operating position, the pressure receiving sections 30Ab and 31Ab of the vertical resistive element 30A and the horizontal resistive element 31A receive the water resistance generated during traveling of the watercraft 1. As a result, a force for decelerating the body 2 is applied to the body 2. In this case, since the vertical resistive elements 30A and 30B and the horizontal resistive elements 31A and 31B change their tilting angles according to a gripping amount of the deceleration lever 23, the magnitude of the water resistance (i.e., deceleration rate) applied to the body 2 can be changed according to the rider's will during travel.

In the operating position, the pressure receiving section 30Ab of the vertical resistive element 30A is located outward relative to a coupling portion, where the vertical resistive element 30A is coupled to the body 2, in the width direction of the body 2. To be more specific, the entire part of the pressure receiving section 30Ab of the vertical resistive element 30A in the operating position is located outward relative to a coupling portion X, where the vertical resistive element 30A is coupled to the transom board 3*a* by the hinge 35. In this state, in the principle of leverage in which the pressure receiving section 30Ab of the vertical resistive element 30A is a force application point and the coupling portion X is a pivot point, the force applied to the body 2 by the water resistance received in the pressure receiving section 30Ab has a substantially horizontal major component. Therefore, the vertical resistive elements 30A and 30B in the operating position can suppress the stern portion from moving up or the fore portion from moving down. As a result, a sufficient deceleration capability is achieved while suppressing a change in the attitude of the body 2.

In the operating position, the vertical resistive elements 30A and 30B are located inward relative to an outermost end of the body 2 in the width direction of the body 2. To be more specific, in the operating position, the vertical resistive elements 30A and 30B are located inward (at the right side in FIG. 8) relative to the gunnel line G and the outer ends of the stabilizers 34A and 34B. This reduces a chance that the vertical resistive elements 30A and 30B in the operating position contact an obstruction such as a quay. Thus, a failure of the vertical resistive elements 30A and 30B is suitably prevented.

When the deceleration lever 23 is operated, the horizontal resistive elements 31A and 31B move from the non-operating position to the operating position in association with the vertical resistive elements 30A and 30B. In the operating position, the pressure receiving section 31Ab of the horizontal resistive element 31A is located under the coupling portion, wherein the horizontal resistive element 31A is coupled to the body 2. To be more specific, the entire part of the pressure receiving section 31Ab of the horizontal resistive element 31A in the operating position is located under a coupling portion Y, where the horizontal resistive element 31A is coupled to the transom board 3*a* by the hinge 36. In this state, in a principle of leverage in which the pressure receiving section 31Ab of the horizontal resistive element 31A is a force application point and the coupling portion Y is a pivot point, the force applied to the body 2 by the water resistance received in the pressure receiving section 31Ab has a substantially upward component. The water resistance for producing a deceleration effect is divided to be received in both the vertical resistive element 30A and the horizontal resistive element 31A, and the horizontal resistive elements 31A and 31B are tilted slightly downward toward the center of the body 2. Therefore, the horizontal resistive elements 31A and 31B in the operating position can suitably suppress the stern portion from moving up or the fore portion from moving down.

The rider can stop deceleration by the resistive elements 30A, 30B, 31A and 31B, by releasing the deceleration lever 23. Upon the deceleration lever 23 being released, the resistive elements 30A, 30B, 31A and 31B return to their non-operating positions by the force applied from the spring, and these elements are inhibited from generating water resistance.

Although in this embodiment, both of the vertical resistive elements 30A and 30B and the horizontal resistive elements 31A and 31B are provided, the horizontal resistive elements 31A and 31B may be omitted. Although in this embodiment, the resistive elements 30A, 30B, 31A and 31B are mechanically coupled to the deceleration lever 23 and mechanically driven, they may be driven by an actuator controlled by a controller in response to the input of the deceleration operation unit. Although in this embodiment, the deceleration lever 23 is used as the deceleration operation unit, the configuration of the deceleration operation unit is not particularly limited, so long as the rider can operate the deceleration operation unit. Although in this embodiment, the hinges 35 and 36 are used as the rotation mechanism for allowing the resistive elements 30A, 30B, 31A and 31B to rotate, any other configuration of the rotation mechanism may be used so long as it is capable of rotating the resistive elements 30A, 30B, 31A and 31B. Although in this embodiment, the resistive elements 30A, 30B, 31A and 31B are configured to be rotatable, they may move to an advanced position to outside from the body 2 in the operating position and move to a retracted position into the inside of the body 2 in the non-operating position.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft configured to eject water rearward from a body thereof to generate a propulsive force, comprising:

a first pair of right and left resistive elements which are attached to a rear portion of the body and configured to be able to receive water resistance during travel of the watercraft, the resistive elements of the first pair being configured to move between an operating position and a non-operating position, and the water resistance on each of the resistive elements of the first pair being larger in the operating position than in the non-operating position;

an auxiliary pair of right and left auxiliary resistive elements positioned below the first pair of resistive elements, attached to the rear portion of the body, and configured to be able to receive water resistance on a respective pressure receiving section during traveling of the watercraft, the auxiliary resistive elements being configured to move between an operating position and a non-operating position, the water resistance on each of the auxiliary resistive elements being larger in the operating position than the non-operating position;

wherein each of the resistive elements of the first pair includes a pressure receiving section configured to receive the water resistance in the operating position; and wherein in the operating position, at least a portion of each pressure receiving section of each resistive element of the first pair respectfully is located leftwardly or rightwardly outward relative to a coupling portion where the resistive element is coupled to the body, in a width direction of the body; and wherein in the operating position, at least a portion of each pressure receiving section of each auxiliary resistive element of the auxiliary pair is located under a coupling portion where the auxiliary resistive element is coupled to the body.

2. The personal watercraft according to claim 1, wherein each of the resistive elements of the first pair includes a pivot point portion having a rotational axis extending substantially vertically;

wherein in the non-operating position, each of the resistive elements of the first pair is in a first attitude where the corresponding pressure receiving section extends along a longitudinal direction of the body; and wherein in the operating position, each of the resistive elements of the first pair is in a second attitude where the pressure receiving section is tilted with respect to the longitudinal direction of the body.

3. The personal watercraft according to claim 2, wherein the resistive elements of the first pair are attached to a left end portion and a right end portion of a transom board of the body, respectively such that each of the resistive elements of the first pair is rotatable around a front end portion thereof, which is the pivot point portion.

4. The personal watercraft according to claim 3, wherein in the non-operating position, the pressure receiving section of each resistive element of the first pair is located inward relative to an outer edge of the transom board in the width direction of the body, as viewed from a rear; and wherein in the operating position, at least a portion of the pressure receiving section of each resistive element of the first pair is located outward relative to the outer edge of the transom board in the width direction of the body, as viewed from the rear.

5. The personal watercraft according to claim 1, wherein in the operating position, each of the resistive elements of the first pair is located inward relative to an outermost end of the body in the width direction.

6. The personal watercraft according to claim 1, further comprising:

a deceleration operation unit which is configured to be operated by a rider of the watercraft;

wherein the resistive elements of the first pair are configured to move in association with each other from the non-operating position to the operating position to decelerate the watercraft, in response to an operation of the deceleration operation unit, and the auxiliary resistive elements of the auxiliary pair are configured to move in association with each other from the non-operating position to the operating position to decelerate the watercraft, in response to the operation of the deceleration operation unit.

7. The personal watercraft according to claim 6, wherein the deceleration operation unit is a deceleration lever; and wherein the deceleration lever is mechanically coupled to each of the resistive elements of the first pair and each of the auxiliary resistive elements of the auxiliary pair via a driving power transmission mechanism.

8. The personal watercraft according to claim 6, wherein each of the resistive elements of the first pair is biased to the non-operating position by an associated spring.

9. The personal watercraft according to claim 1, wherein each of the first pair of resistive elements is moved respectively leftwardly or rightwardly outward in the operating position to decelerate the watercraft and each of the auxiliary resistive elements of the auxiliary pair is moved downwardly in the operating position to decelerate the watercraft.

10. The personal watercraft according to claim 1, wherein an attitude of the watercraft remains unchanged when the first pair of resistive elements and the auxiliary pair of auxiliary resistive elements are moved into the operating position.

* * * * *